US007077633B2

(12) United States Patent
Yoda

(10) Patent No.: US 7,077,633 B2
(45) Date of Patent: Jul. 18, 2006

(54) ELECTRIC COMPRESSOR

(75) Inventor: Seiichiro Yoda, Chiba (JP)

(73) Assignee: Calsonic Compressors Manufacturing Inc. (JP)

( * ) Notice: Subject to any disclaimer, the term of this patent is extended or adjusted under 35 U.S.C. 154(b) by 415 days.

(21) Appl. No.: 10/463,707

(22) Filed: Jun. 17, 2003

(65) Prior Publication Data

US 2004/0005229 A1 Jan. 8, 2004

(30) Foreign Application Priority Data

Jul. 2, 2002 (JP) ..... 2002-193592

(51) Int. Cl.
*F04C 29/02* (2006.01)
*F04B 17/00* (2006.01)

(52) U.S. Cl. ..... 417/371; 417/410.3; 418/100; 184/6.16

(58) Field of Classification Search ..... 417/410.3, 417/371; 418/100, 268; 184/6.16
See application file for complete search history.

(56) References Cited

U.S. PATENT DOCUMENTS

| | | | | |
|---|---|---|---|---|
| 5,098,266 | A | 3/1992 | Takimoto et al. | 418/63 |
| 5,533,875 | A | 7/1996 | Crum et al. | 417/368 |
| 5,683,229 | A * | 11/1997 | Stoll et al. | 417/366 |
| 6,171,076 | B1 | 1/2001 | Gannaway | 417/350 |

FOREIGN PATENT DOCUMENTS

EP 0308119 3/1989

* cited by examiner

*Primary Examiner*—Charles G. Freay
(74) *Attorney, Agent, or Firm*—Adams & Wilks

(57) ABSTRACT

A horizontal-type electric motor driven compressor comprises a casing, a suction chamber formed in the casing, an electric motor arranged on a suction chamber side in the casing, a compressor section driven by the motor in the casing about a horizontal axis of rotation extending in a longitudinal direction of the casing, a suction opening provided in the compressor section, and a refrigerant passage having an inlet communicating with the suction opening and communicating the suction chamber to the suction opening. The refrigerant passage is the sole refrigerant passage between the suction chamber and the suction opening. The inlet of the refrigerant passage is provided in a lowermost portion at a bottom of the casing.

20 Claims, 11 Drawing Sheets

ELECTRIC COMPRESSOR

BACKGROUND OF THE INVENTION

1. Field of the Invention

The present invention relates generally to electric compressors and, more specifically, to a horizontal type electric compressor formed by accommodating in a casing a compressor section and an electric motor for driving the same.

2. Description of the Related Art

In an electric compressor, the compressor is connected to a motor through a drive force transmitting portion, and is rotated by a drive force of the motor to compress fluid. The motor, the drive force transmitting portion, and the compressor section are accommodated as a unit in a casing.

As an electric compressor of this type, the applicant of the present invention has proposed in Japanese Patent Application No. 2002-55672 a horizontal type one as shown in FIG. 12.

In this electric compressor, a compressor section 20A and a motor 10 for driving the same are accommodated in a casing 2'. A motor rotor 16 is connected to an extension portion of a rotor shaft 27 of a compressor section 20, and the motor 10 is formed by a stationary stator 11 of the casing 2' and the motor rotor 16.

When the compressor section 20A is driven by the motor 10, a refrigerant sucked in through a refrigerant suction port 7 flows through communication passages 54 of a suction chamber 50 and a narrow gap between the stator 11 and the motor rotor 16 of the motor 10 and is sucked into the compressor section 20A to be compressed therein and discharged into a discharge chamber 52 before being supplied to the exterior through a refrigerant discharge port 9.

Since the motor is cooled by the sucked refrigerant flowing around the motor 10, it is possible to improve the motor in terms of efficiency.

By the way, there are provided, for example, four communication passages 54 are in a circumferential direction of the stator 11, between the casing 2' and the stator 11. However, the sectional areas of the refrigerant passages in the suction chamber 50, inclusive of these communication passages 54, are not uniform. Further, the pasages cannot help forming rather complicated routes. Thus, there are involved portions where the flow velocity of the refrigerant is lowered and portions where the refrigerant is allowed to stay.

In this case, the sucked refrigerant contains a minute amount of lubricant in the form of a mist, and this lubricant may gather at the bottom portion (lower portion) of the casing 2', where the flow velocity is lowered or the refrigerant is allowed to stay as mentioned above.

In such a case, the lubricant has been removed from the refrigerant, which means a shortage of the lubricant entering the compressor section. Thus, there is no saying with assurance that the compressor is absolutely free from wear, heat generation, or adhesion due to insufficient lubrication, or a reduction in the amount of the refrigerant discharged due to insufficient sealing.

SUMMARY OF THE INVENTION

In view of the above, it is an object of the present invention to provide an improved electric compressor which does not incur any shortage of the lubricant in the compressor section even when the refrigerant flow velocity is lowered and which does not allow the lubricant to stay at the bottom of the casing.

Consequently, an electric compressor of the present invention is an electric compressor in which a compressor section is driven in a casing by a motor arranged on the side of a suction chamber for receiving a refrigerant, and an inlet of a refrigerant passage from the suction chamber to a suction opening for the refrigerant is provided in the lower portion of the casing.

Further, the present invention is an electric compressor in which the compressor section is composed of a rotary member with a rotor shaft and a stationary member supporting the rotary member and equipped with the suction hole, and the refrigerant passage includes an introduction or introduce passage formed in the stationary member and extending from the suction hole to open in the lower portion of the stationary member.

Further, the present invention is an electric compressor in which the casing is equipped with a partition wall to be brought into contact with the stationary member; the introduce passage is formed by covering a groove formed in the stationary member with the partition wall; an opening hole communicating with the groove is provided in the lower portion of the partition wall; and the opening hole constitutes the inlet of the refrigerant passage.

Further, the present invention is an electric compressor in which the introduce passage is formed by covering the groove formed in the stationary member with a cover member mounted to the stationary member so as to allow a lower end of the groove to communicate with the suction chamber, and the lower end of the groove constitutes the inlet of the refrigerant passage.

Further, the present invention is an electric compressor in which the compressor section is composed of a rotary member with a rotor shaft and a stationary member supporting the rotary member and equipped with the suction hole; the refrigerant passage is composed of a communication hollow portion formed in an attachment mounted to the stationary member and corresponding to the suction hole and an introduce passage extending from the communication hollow portion to a lower end portion; and a forward end of the introduce passage constitutes the inlet of the refrigerant passage.

Further, the present invention is an electric compressor in which the casing is equipped with a partition wall on the suction chamber side of the stationary member and has in the partition wall a suction hole corresponding to the suction opening; the refrigerant passage is composed of a communication hollow portion formed in an attachment mounted to the partition wall and corresponding to the suction hole and an introduce passage extending from the communication hollow portion to a lower end portion; and a forward end of the introduce passage constitutes the inlet of the refrigerant passage.

Further, the present invention is an electric compressor in which the casing has an enlarged portion with its bottom portion swollen outwards, with the inlet of the refrigerant passage being situated at the enlarged portion.

DESCRIPTION OF THE PREFERRED EMBODIMENT

Embodiment modes of the present invention will now be described by way of examples.

First Embodiment

Figure 1:
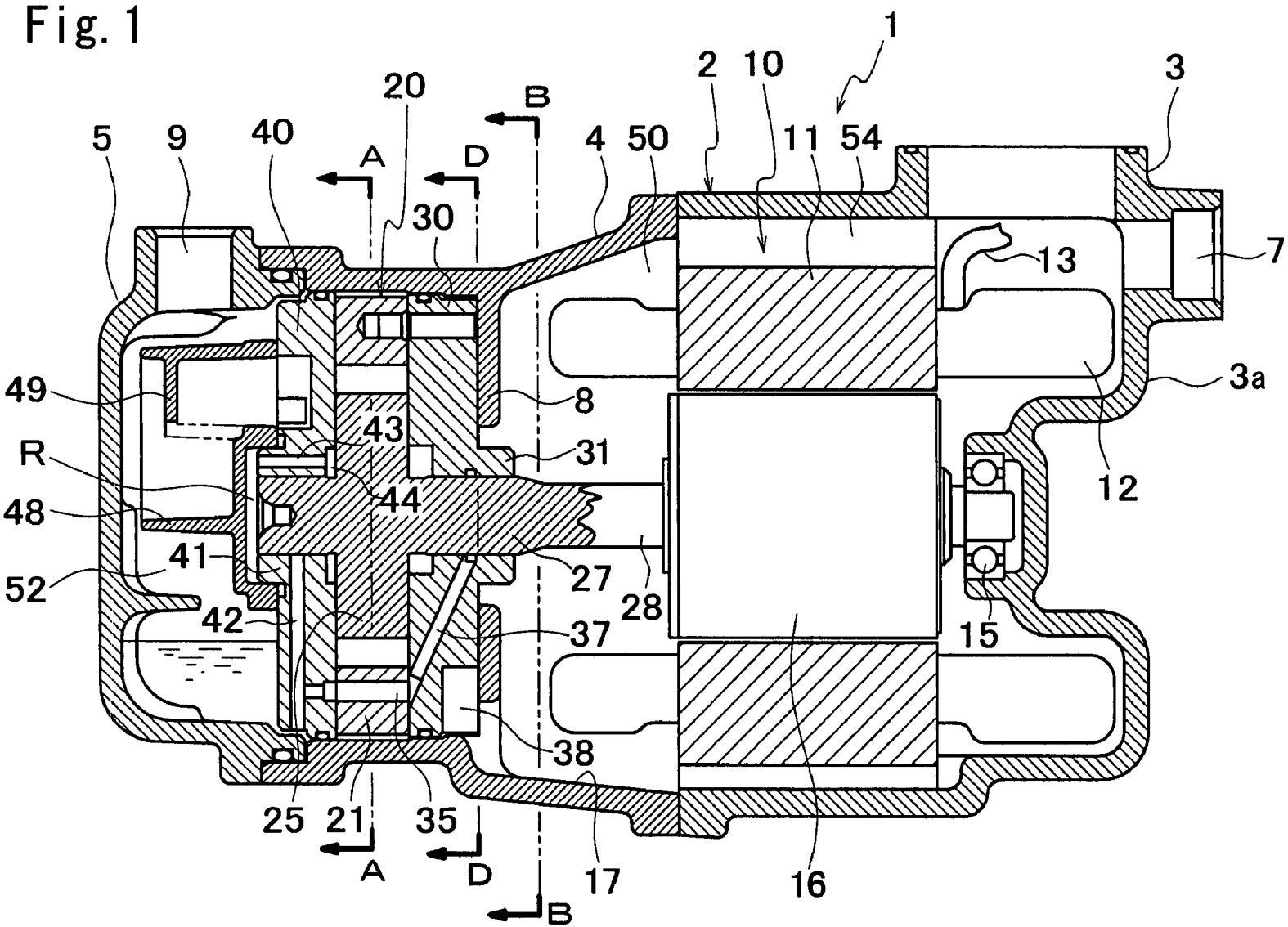
FIG. 1 is a longitudinal sectional view showing a first embodiment of the present invention.
Figure 2:
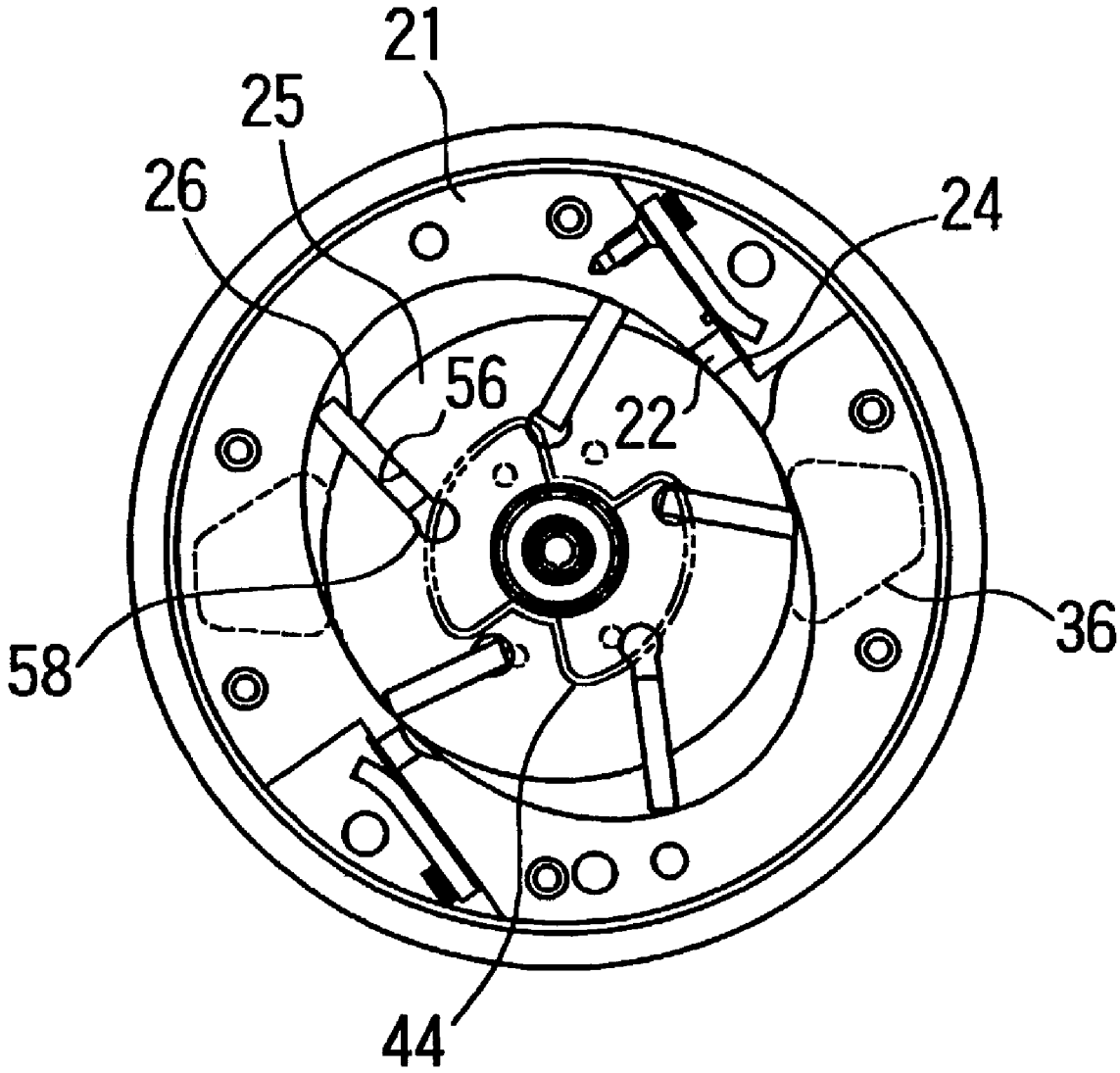
FIG. 2 is a sectional view taken along the line A—A of FIG. 1.

FIG. 1 is a longitudinal sectional view of a first embodiment, and FIG. 2 is a sectional view taken along the line A—A of FIG. 1.

An electric compressor 1 has a casing 2, which is composed of three members including a front case 3, a center case 4, and a rear case 5.

The front case 3 is formed as a bottomed cylinder, to the opening side of which there is mounted a stator 11 equipped with a coil 12. A connector (not shown) of a cable 13 extending from the coil 12 is hermetically mounted to a side wall on the end-wall 3*a* side of the front case 3, whereby power is supplied from outside.

The coil 12 protrudes from the opening end surface of the front case 3 to extend into the center case 4.

The side wall on the end-wall 3*a* side of the front case 3 is provided with a refrigerant suction port 7, through which a refrigerant is sucked from outside.

The center case 4 is formed as a cylinder with both sides open, and has at its axial center a partition wall 8 for mounting a compressor section 20.

As shown in FIG. 2, in the compressor section 20, a compressor rotor 25 equipped with a plurality of vanes 26 is rotatably provided inside a cylinder 21 with an elliptical inner peripheral surface, with the cylinder 21 being held between a front side block 30 and a rear side block 40 to form a vane rotary type compressor.

The compressor rotor 25 has a rotor shaft 27 supported on the rear side by a support portion 41 of the rear side block 40 and on the front side by a support portion 31 of the front side block 30.

Here, the compressor rotor 25 corresponds to the rotary member, and the front side block 30 corresponds to the stationary member, of the present invention.

The front side block 30, the cylinder 21, and the rear side block 40 are integrally joined by bolts (not shown), and are fixed to the partition wall 8. The partition wall 8 extends radially to a position near the support portion 31 of the front side block 30.

The front side block 30 has a suction opening 36 (See FIG. 2). Mounted to the rear side block 40 is a cyclone block 48 equipped with an oil separator 49.

The rotor shaft 27 of the compressor rotor 25 has an expand portion 28 extending through the support portion 31 into the front case 3, and a forward end of the expand portion 28 is supported by a bearing 15 provided in the end-wall 3*a* of the front case 3.

Fixed to the expand portion 28 of the rotor shaft 27 is a motor rotor 16 aligned with the stator 11 in an axial direction. Thus, the stator 11 and the motor rotor 16 form a motor 10.

Further, a space of the front case 3 where the refrigerant suction port 7 is provided and the space on the front side of the front side block 30 mounted to the partition wall 8 of the center case 4 form a suction chamber 50 for the refrigerant, with the motor 10 being sandwiched between them, and there are provided a plurality of communication passages 54 extending along the side wall of the front case 3 and connecting the spaces in front of and behind the stator 11.

The rear case 5 is formed as a bottomed cylinder; it accommodates the cyclone block 48 protruding from the rear end surface of the center case 4, and forms a discharge chamber 52. Provided in the upper side wall of the rear case 5 is a refrigerant discharge port 9; the refrigerant discharged from the compressor section 20 by way of the oil separator 49 is supplied to the exterior through the refrigerant discharge port 9.

A predetermined amount of lubricant is stored in the discharge chamber 52. Formed in the rear side block 40 is an oil passage 42, which is open at the bottom portion of the discharge chamber 52, in an installed state of this electric compressor 1, and which leads to the hole surface of the support portion 41. Further, provided in the surface of the rear side block 40 opposed to the compressor rotor 25 is a hollow portion (flat groove) 44 arranged so as to communicate with back pressure chambers 58 of vane grooves 56 supporting the vanes 26 of the compressor rotor 25.

Then, an enclosed space R between the cyclone block 48 and the rear side block 40 and the hollow portion 44 are connected by a communication passage 43.

The lubricant having reached the hole surface of the support portion 41 by way of the oil passage 42 under the discharge pressure of the discharge chamber 52 flows to the hollow portion 44 and the enclosed space R through a gap between the hole of the support portion 41 and the rotor shaft 27.

Further, provided at the bottom of the cylinder 21 is a through-hole 35 connected to the oil passage 42 of the rear side block 40, and this through-hole 35 and the hole of the support portion 31 of the rotor shaft 27 in the front side block 30 are connected by an oil passage 37 formed in the front side block 30 to thereby introduce lubricant to the support portion 31.

Further, a connection between the front case 3 and the center case 4 and a connection between the center case 4 and the rear case 5 are effected hermetically by using a common connecting means; a bolt connection is effected by using flange portions (not shown) appropriately formed on the respectively opposing surfaces, with seal rings, gaskets or the like being held therebetween.

In this embodiment, the suction opening 36 of the front side block 30 is closed by the partition wall 8, and communicates with the suction chamber 50 through an introduction or introduce passage.

Figure 3:
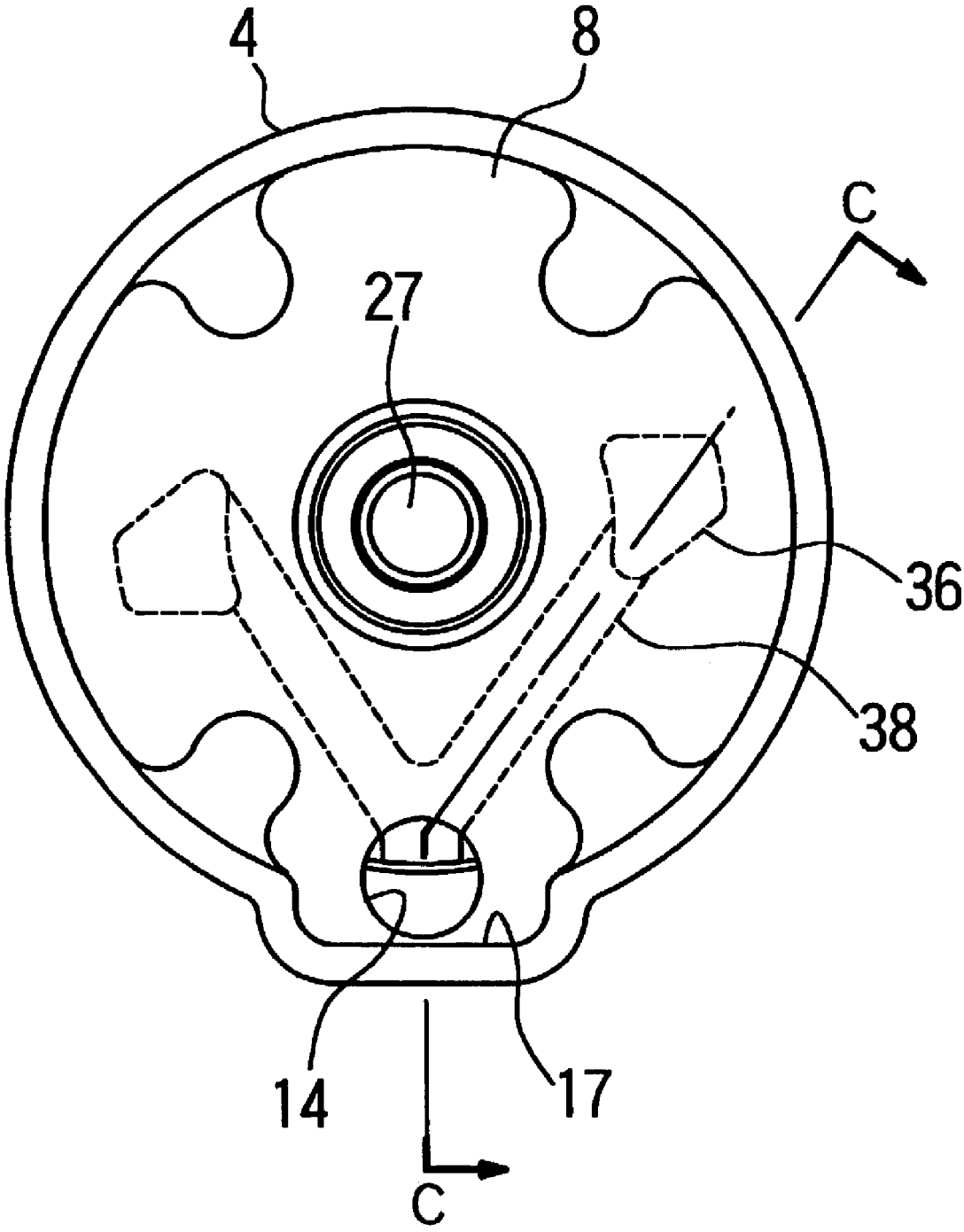
FIG. 3 is a sectional view taken along the arrow line B—B of FIG. 1.
Figure 4:
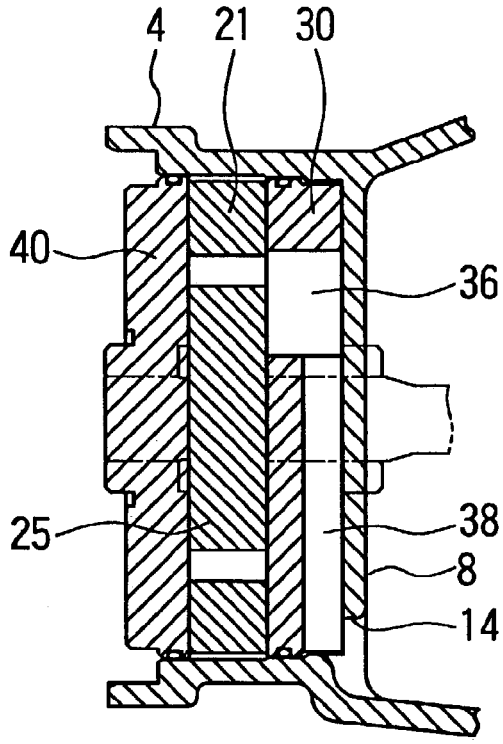
FIG. 4 is a sectional view taken along the line C—C of FIG. 3.
Figure 5:
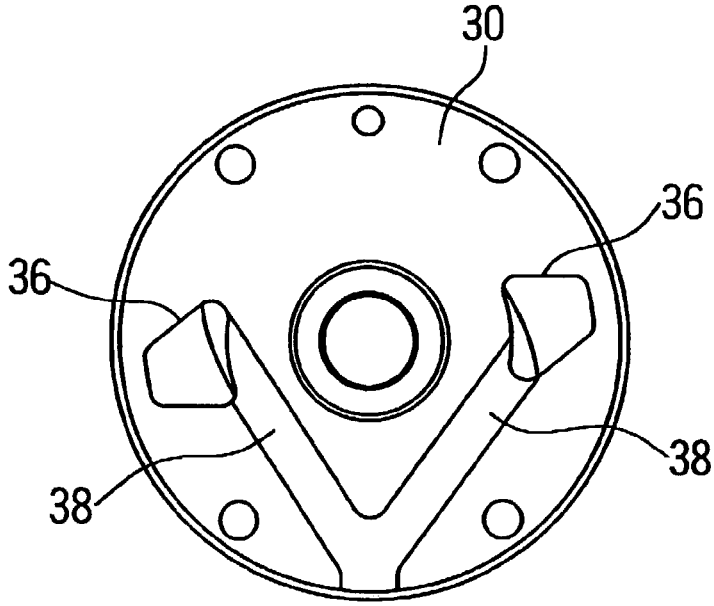
FIG. 5 is a sectional view taken along the arrow line D—D of FIG. 1.

FIG. 3 is a sectional view taken along the arrow line B—B of FIG. 1, FIG. 4 is a sectional view taken along the line C—C of FIG. 3, and FIG. 5 is a sectional view taken along the arrow line D—D of FIG. 1.

In the installed state of the electric compressor 1, the suction opening 36 of the front side block 30 is substantially situated in a horizontal line on either side of the rotor shaft 27 of the compressor rotor 25. Further, an opening hole 14 is provided in the lowermost portion of the partition wall 8 in the installed state of the electric compressor 1.

Formed in the suction chamber 50 side surface of the front side block 30 are grooves serving as introduce passages 38 extending from the suction openings 36 to the peripheral surface in the lowermost portion of the front side block 30. Then, the introduce passages 38 and the suction openings 36 are covered with the partition wall 8.

On the suction chamber 50 side with respect to the axial middle position of the front side block 30, the center case 4 has an enlarged portion 17 whose bottom part or portion projects or is swollen outwardly over a predetermined width in the circumferential direction, and, in this enlarged portion 17 also, the partition wall 8 is connected to the side wall (bottom wall) of the center case 4. Then, the lower edge of the opening hole 14 is situated in the bottom wall of the enlarged portion 17.

The introduce passages 38 are also open in the lower peripheral surface of the front side block 30, communicating with the suction chamber 50 over the surface in contact with the partition wall 8 and the peripheral surface.

In this embodiment, the introduce passages 38 and the opening hole 14 constitute the refrigerant passage of the present invention.

In this electric compressor 1, constructed as described above, the compressor section 20 and the motor 10 are accommodated in the casing 2 and insulated from outside to form a horizontal type enclosed electric compressor.

By driving the motor 10, the compressor rotor 25 of the compressor section 20 equipped with the rotor shaft 27 shared by the motor rotor 16 rotates, and the refrigerant sucked in through the refrigerant suction port 7 flows in the end-wall-side space of the suction chamber 50 through the communication passages 54 and the gap between the stator 11 and the motor rotor 16 of the motor 10 to the space on the compressor section 20 side. In this process, the motor is cooled by the flowing sucked refrigerant around the motor.

Then, the sucked refrigerant flows from the opening hole 14 of the partition wall 8 to the suction openings 36 by way of the introduce passages 38 before the refrigerant is sucked into the cylinder 21. The refrigerant compressed inside the cylinder 21 is discharged into the discharge chamber 52 through a discharge hole 22 (See FIG. 2) equipped with a reed valve 24 before the refrigerant is supplied to the exterior through the refrigerant discharge port 9.

In this first embodiment, constructed as described above, the casing 2 is divided into three portions. The stator 11 of the motor 10 is mounted to the front case 3. On the other hand, mounted to the center case 4 is a sub assembly obtained by fixing the motor rotor 16 of the motor 10 to the rotor shaft 27 (extend portion 28) of the rotor of the compressor section 20 assembled beforehand. Thereafter, connections are effected between the front case 3 and the center case 4 and between the center case 4 and the rear case 5, thus allowing assembly. In particular, since the main components are divided between the front case 3 and center case 4 and allow assembly as separate components by different processes, the handling of the components in the assembly operation process is facilitated.

Then, the refrigerant in the suction chamber 50 flows from the opening hole 14 of the partition wall 8 to the suction openings 36 through the introduce passages 38 to be sucked into the cylinder 21, with the opening hole 14 being arranged at the bottom of the suction chamber 50. With this arrangement, even when the lubricant threatens to gather at the bottom portion of the suction chamber 50 as a result of the reduction in the flow velocity of the sucked refrigerant, etc., the lubricant is sucked into the opening hole 14 and into the introduce passages 38 to be guided to the suction openings 36. At this time, since the bottom portion of the suction chamber 50 is formed as the enlarged portion 17, the portion functions as a passage for guiding the lubricant to the opening hole 14, and the lubricant is efficiently sucked into the opening hole 14.

Thus, there is no fear of the lubricant staying at the bottom of the casing 2, in particular, of the suction chamber 50 to cause a shortage of lubricant entering the compressor section 20 and deficiency in lubrication, whereby it is possible to prevent wear, heat generation, and cohesion of the compressor section 20, and a reduction in the amount of refrigerant discharged due to insufficient sealing.

Second Embodiment

Next, a second embodiment will be described. In this embodiment, the partition wall for mounting the compressor section 20 to the center case 4 does not extend to a position near the support hole 31 of the front side block 30.

Figure 6:
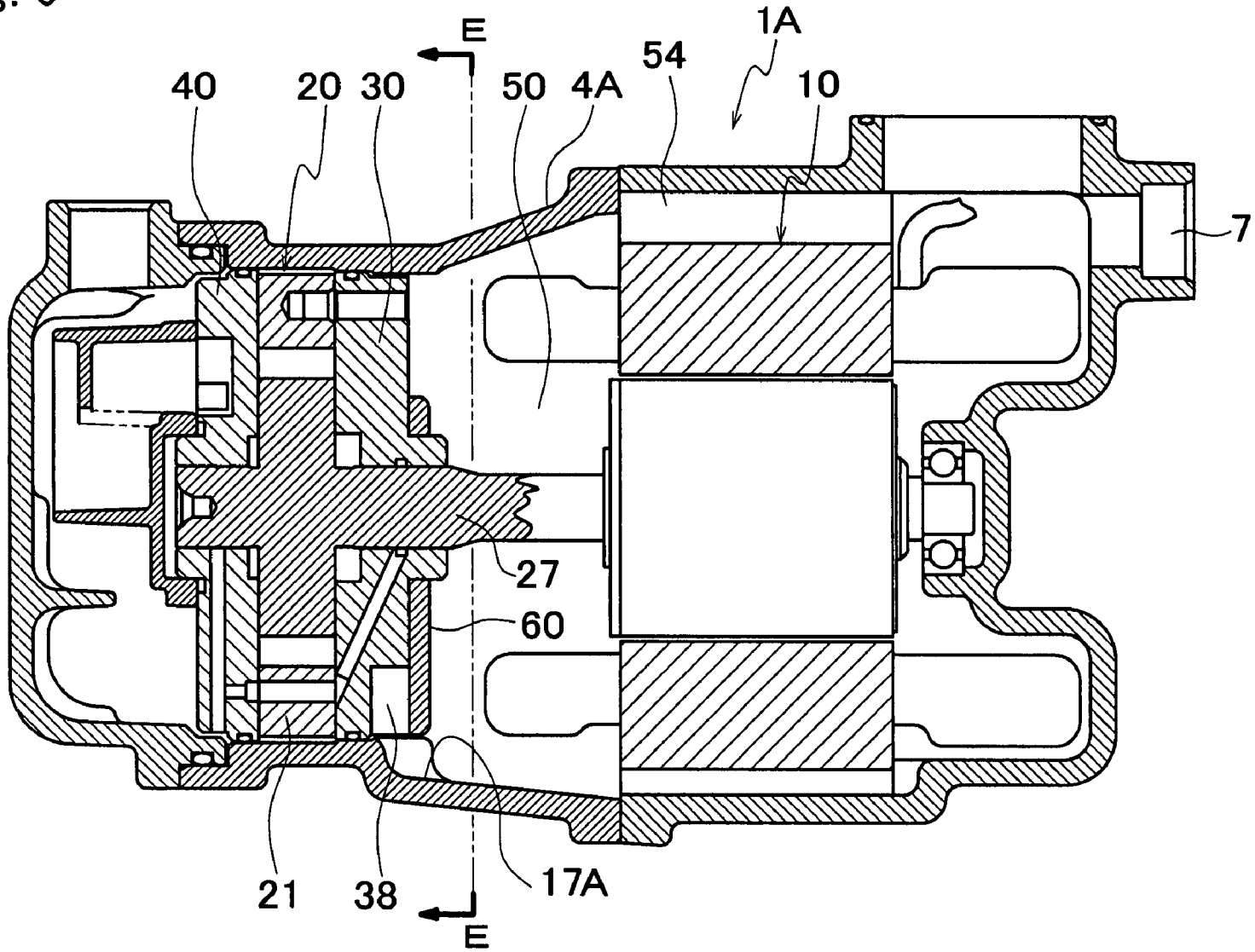
FIG. 6 is a longitudinal sectional view showing a second embodiment of the present invention.
Figure 7:
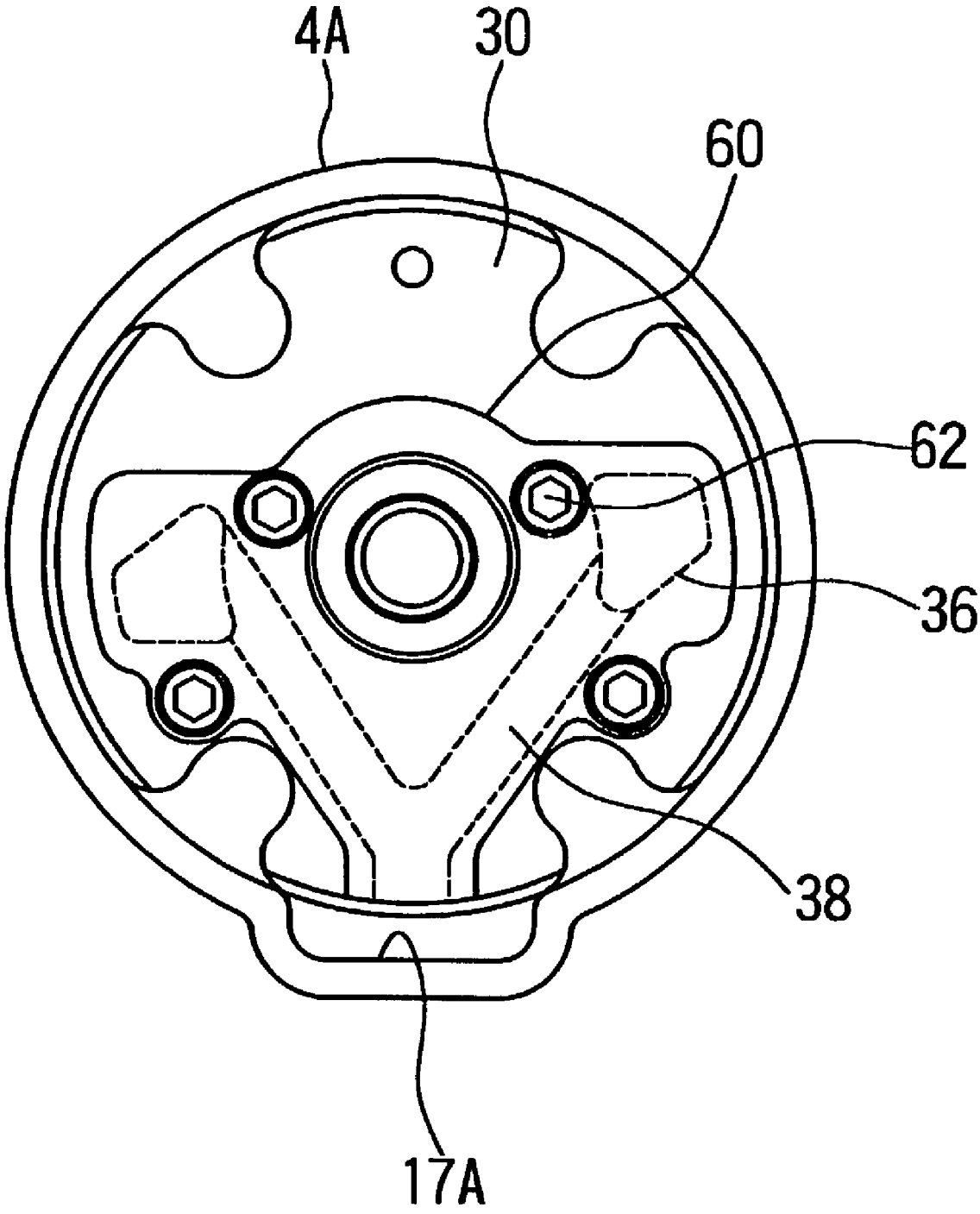
FIG. 7 is a sectional view taken along the arrow line E—E of FIG. 6.

FIG. 6 is a longitudinal sectional view of the second embodiment, and FIG. 7 is a sectional view taken along the arrow line E—E of FIG. 6.

Although not shown in particular, in an electric compressor 1A of this embodiment, there are provided, along an inner periphery of a center case 4A, as many partition walls as required for effecting bolt connection of the compressor section 20 abutted.

As in the first embodiment, in the surface of the front side block 30 on the suction chamber 50 side, there are formed, as the introduce passages 38, grooves extending from the suction openings 36 to the lowermost peripheral surface in the installed state of the electric compressor 1A.

Besides, in this second embodiment, a cover member 60 covering the suction openings 36 and the introduce passages 38 from the suction chamber 50 side is mounted to the front side block 30 by means of bolts 62. The introduce passages 38 are open in the lower peripheral surface of the front side block 30.

The center case 4A has, on the suction chamber 50 side with respect to the axial middle position of the front side block 30, an enlarged portion 17A with its bottom portion swollen outwardly over a predetermined width in a circumferential direction, and communication is established between the introduce passages 38 and the suction chamber 50 by this enlarged portion 17A. In this case, the introduce passages 38 constitute the refrigerant passage of the invention.

Otherwise, this embodiment is of the same construction as the first embodiment.

In this second embodiment, constructed as described above, the refrigerant in the suction chamber 50 flows from the enlarged portion 17A below the suction chamber 50 through the introduce passages 38 to reach the suction openings 36 before being sucked into the cylinder 21, so that any lubricant accumulated at the bottom of the suction chamber 50 is sucked into the introduce passages 38 together with the refrigerant and guided to the suction openings 36. Thus, as in the first embodiment, it is possible to prevent wear, heat generation, and cohesion of the compressor-section and a reduction in the amount of refrigerant discharged due to insufficient sealing.

Further, while in this second embodiment the cover member 60 entirely covers the suction chamber 50 side of the introduce passages 38, and the introduce passages 38 communicate with the suction chamber 50 solely through the opening in the lower peripheral surface of the front side block 30, it is also possible to partially cut out the lower end of the cover member 60 so that, as in the first embodiment, the introduce passages 38 may communicate with the suction chamber 50 over the surface on the suction chamber 50 side of the front side block 30 and the lower peripheral surface.

Third Embodiment

Next, a third embodiment will be described. In this embodiment, an attachment equipped with introduce passages is mounted to a partition wall provided in the center case.

Figure 8:
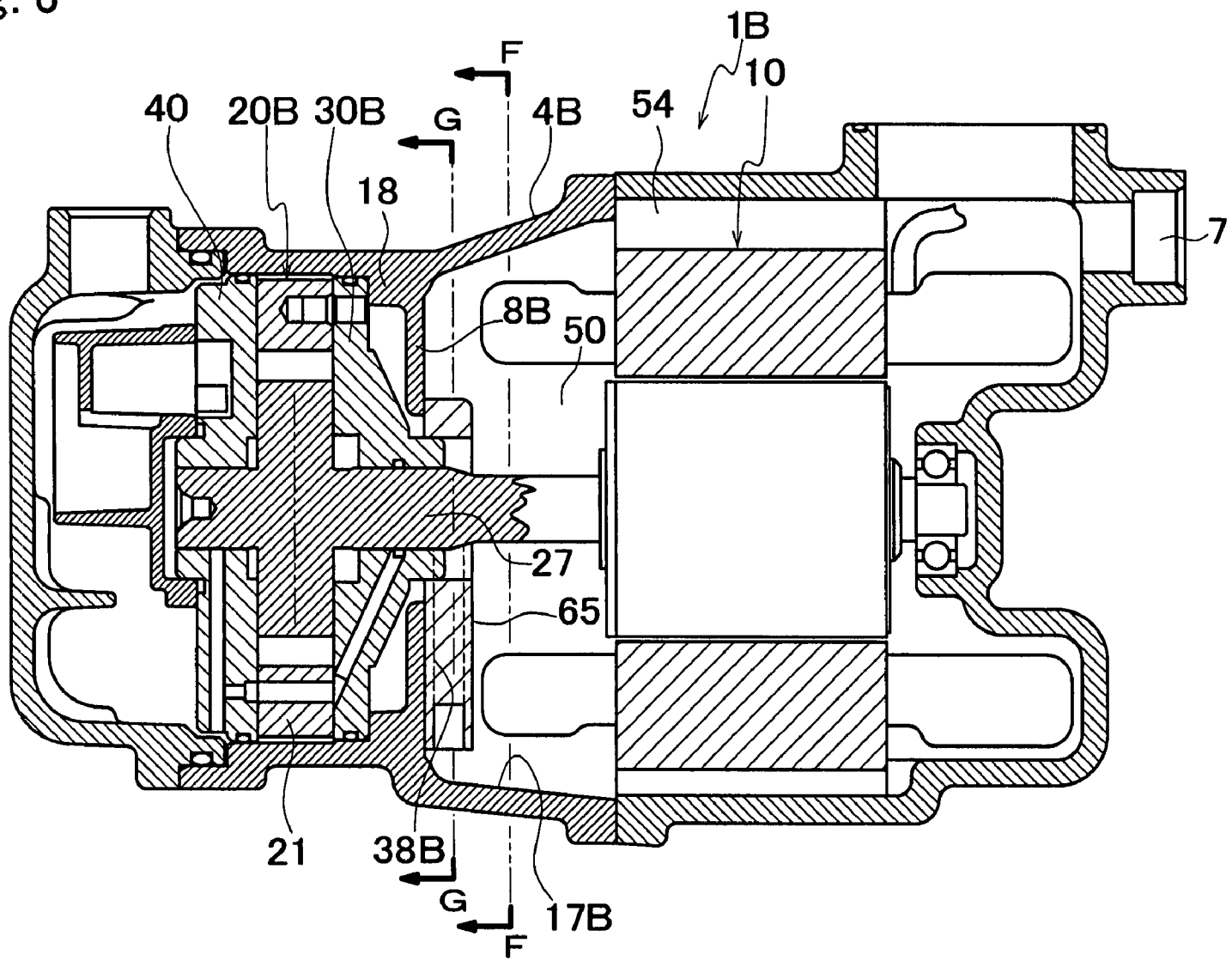
FIG. 8 is a longitudinal sectional view showing a third embodiment of the present invention.
Figure 9:
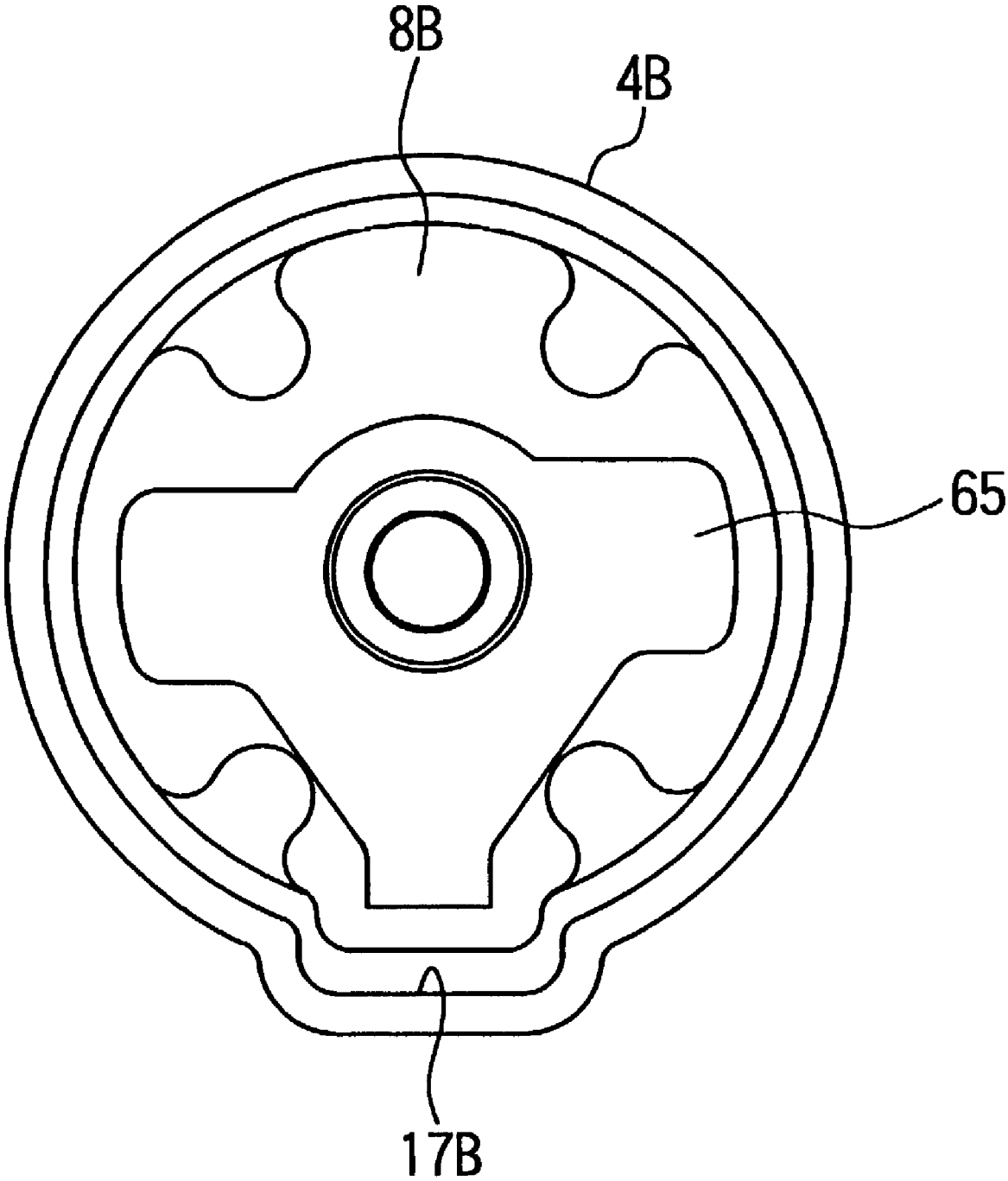
FIG. 9 is a sectional view taken along the arrow line F—F of FIG. 8.
Figure 10:
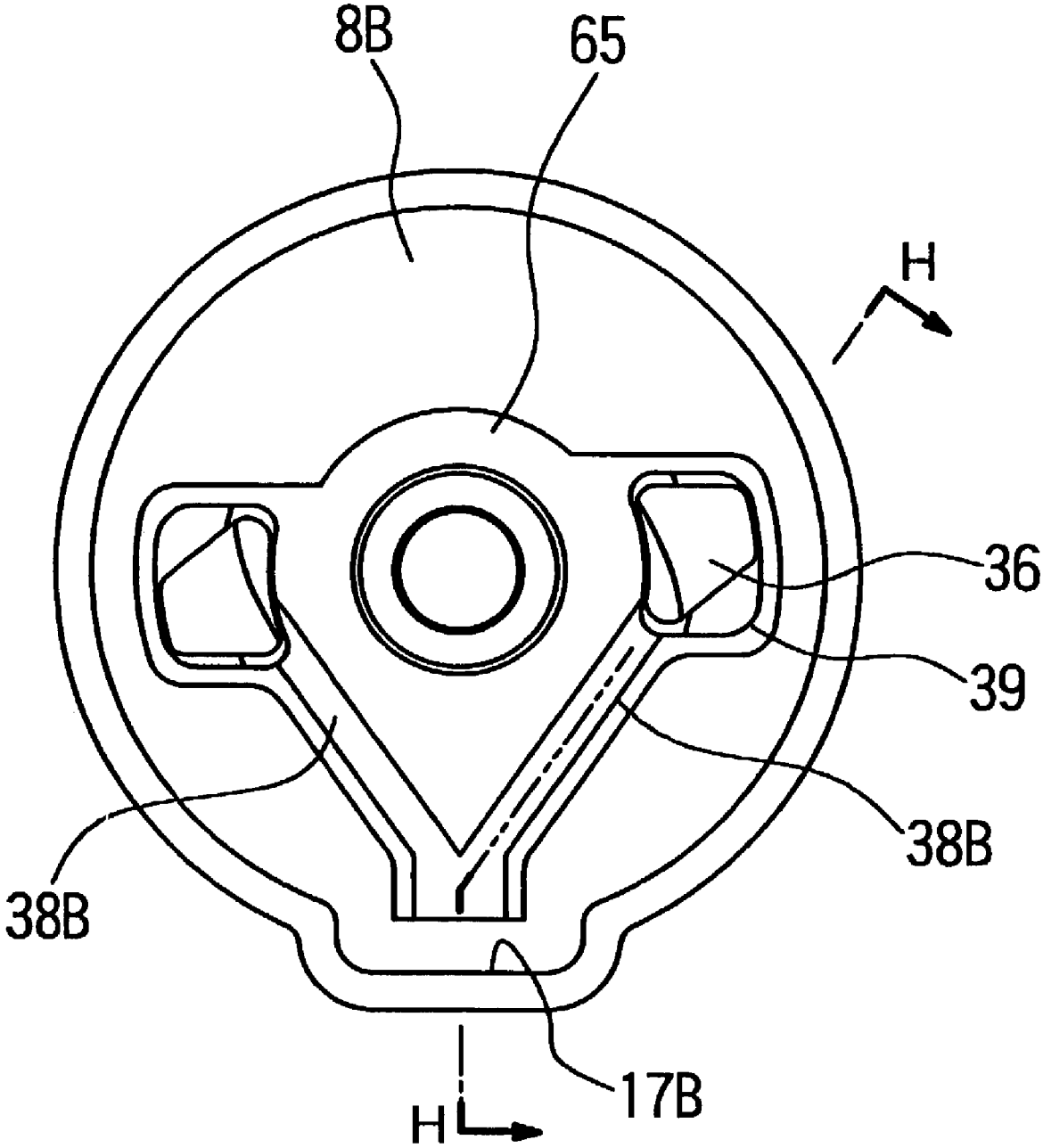
FIG. 10 is a sectional view taken along the line G—G of FIG. 8.
Figure 11:
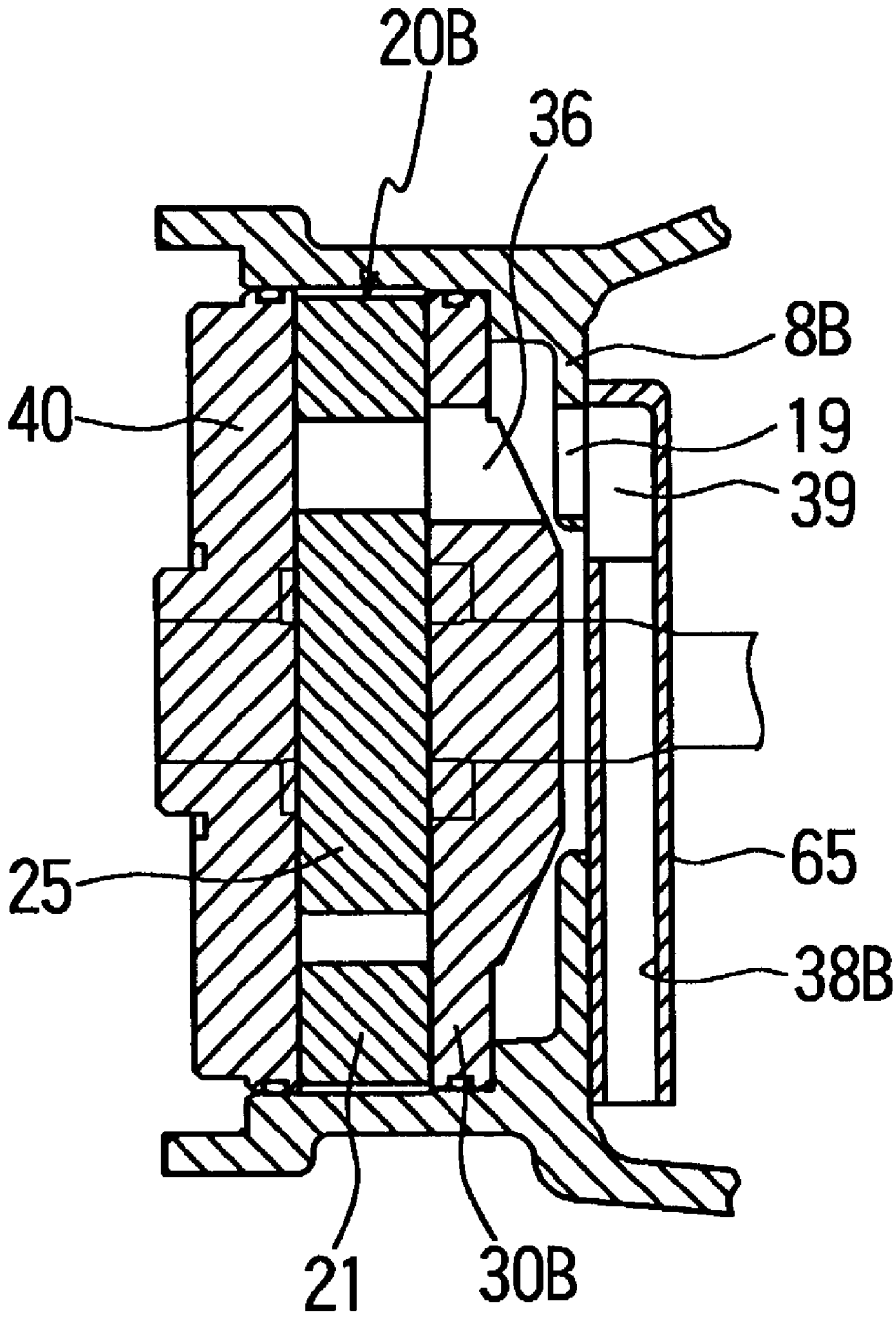
FIG. 11 is a sectional view taken along the line H—H of FIG. 10.
Figure 12:
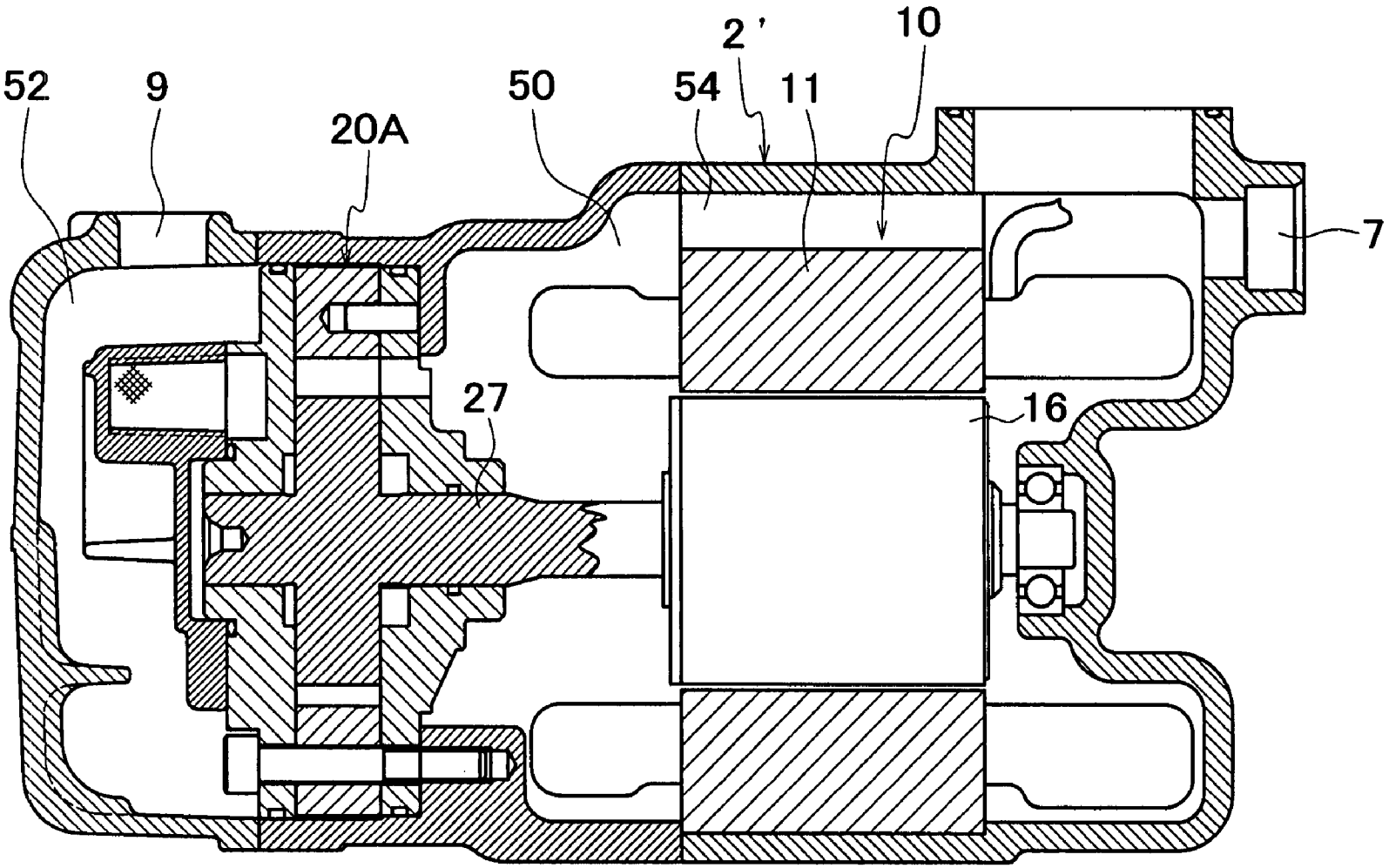
Fig. 12 PRIOR ART
FIG. 12 is a diagram showing an electric compressor on which the present invention is based.

FIG. 8 is a longitudinal sectional view of the third embodiment, FIG. 9 is a sectional view taken along the arrow line F—F of FIG. 8, FIG. 10 is a sectional view taken along the arrow line G—G of FIG. 8, and FIG. 11 is a sectional view taken along the line H—H of FIG. 10.

In an electric compressor 1B of this embodiment, the center case 4B is formed as a cylinder open at both ends, which has at the axial center thereof a partition wall 8B, and in the inner periphery of the side wall a level difference portion 18 connected to the partition wall 8B, the compressor section 20B being abutted against the level difference portion 18 for mounting.

In an installed state of the electric compressor 1B, a suction opening 36 of the front side block 30B are situated in a substantially horizontal line and on either side of the rotor shaft 27 of the compressor rotor 25. Further, provided in the partition wall 8B are suction holes 19 (See FIG. 11) corresponding to the suction openings 36.

On the suction chamber 50 side of the partition wall 8, the center case 4B has an enlarged portion 17B whose bottom portion is swollen outwardly over a predetermined width in a circumferential direction.

An attachment 65 is mounted to the suction-chamber-50-side surface of the partition wall 8B by means of bolts (not shown).

The attachment 65 is equipped with communication hollow portions 39 corresponding to the suction holes 19 of the partition wall 8B (See, in particular, FIG. 10) and hole-like introduce passages 38B extending from the communication hollow portions 39, with the communication hollow portions 39 being open on the front side block 30B side to communicate with the suction openings 36 by way of the suction holes 19.

As shown in FIG. 10, the forward end portions of the introduce passages 38B extending from the two communication hollow portions 39 join with each other to open on the enlarged portion 17B at the lower end of the attachment 65.

The refrigerant sucked in through the refrigerant suction port 7 flows in the suction chamber 50 from the space on the end-wall-3*a* side space through the communication passages 54 and the gap between the stator 11 and the motor rotor 16 of the motor 10 to the compressor section 20 side space.

Then, the refrigerant in the suction chamber 50 flows from the enlarged portion 17B through the introduce passages 38B of the attachment 65 to be sucked into the cylinder 21 by way of the communication hollow portions 39, the suction holes 19 of the partition wall 8B, and the suction openings 36 of the front side block 30B.

Here, the introduce passages 38B, the communication hollow portions 39, and the suction holes 19 constitute the refrigerant passage of the invention.

Otherwise, the embodiment is of the same construction as the first embodiment.

In this third embodiment, constructed as described above, the attachment 65 equipped with the introduce passages 38B formed so as to communicate with the suction openings 36 by way of the suction holes 19 of the partition wall 8B, is mounted to the partition wall 8B, and the forward ends of the introduce passages 38B are situated at the bottom portion of the suction chamber 50, so that any lubricant accumulated at the bottom portion of the suction chamber 50 due to a reduction in the flow velocity of the sucked refrigerant, etc. is sucked into the introduce passages 38B together with the refrigerant sucked into the introduce passages 38B, and is guided to the suction openings 36.

Thus, there is no fear of lubricant being allowed to stay at the bottom portion of the suction chamber 50 to cause a shortage of lubricant entering the compressor section 20 and insufficient lubrication, so that it is possible to prevent wear, heat generation, and adhesion of the compressor section 20, a reduction in the amount of refrigerant discharged due to insufficient sealing, etc.

Further, solely by mounting the attachment 65 to the partition wall 8B, it is possible to set the inlets of the refrigerant passages leading to the suction openings 36 at the bottom portion, where lubricant is likely to gather, so that it can be advantageously retrofitted to an existing electric compressor with ease.

While in the third embodiment the attachment 65 is mounted to the partition wall 8B, it is also possible to mount the attachment 65 directly to the front side block 30B, allowing the communication hollow portions 39 to directly communicate with the suction openings when the center case 4B has no partition wall overlapping the suction openings 36 of the front side block 30B.

Further, while in the above embodiments a vane rotary type compressor is formed as the compressor sections 20 and 20B, this should not be construed restrictively. It is also possible for the compressor section to consist of some other arbitrary types of compressor, such as a rolling piston type compressor or a scroll type compressor.

As described above, the present invention provides an electric compressor in which the motor for driving the compressor section is arranged on the refrigerant suction chamber side, in which the inlet of the refrigerant passages extending from the suction chamber to the suction openings of the refrigerant of the compressor section is provided in the lower portion of the casing, whereby any lubricant which threatens to gather at the bottom portion of the suction chamber 50 due to a reduction in flow velocity caused by the passage of the sucked refrigerant around the motor, is sucked into the introduce passages 38 together with the refrigerant sucked into the refrigerant passages and is guided to the suction openings of the compressor section. Thus, it is possible to prevent deficient lubrication due to a shortage of lubricant entering the compressor section, a reduction in the amount of discharged refrigerant due to wear, heat generation, and cohesion of the compressor section or to insufficient sealing, etc.

The refrigerant passages may include introduce passages formed in the stationary member of the compressor section and extending from the suction holes to open in the lower portion of the stationary member. In particular, when the casing is equipped with a partition wall for abutment of the stationary member, the introduce passages are formed easily by forming grooves in the stationary member and covering them with the partition wall; an opening hole communicating with the grooves can be provided in the lower portion of the partition wall, and be used as the inlet of the refrigerant passages.

Further, when the casing is not equipped with any partition wall, the introduce passages are formed easily by covering the grooves formed in the stationary member with a cover member, the lower ends of the grooves constituting the inlet of the refrigerant passages.

Further, an attachment is mounted to the stationary member of the compressor section, and communication hollow portions corresponding to the suction openings and introduce passages extending from the communication hollow portions to the lower end are formed therein to use them as the refrigerant passages, the forward ends of the introduce passages constituting the inlet of the refrigerant passages, whereby it can be easily retrofitted to an existing electric compressor.

Further, when the casing has on the suction chamber side of the stationary member a partition wall equipped with suction holes corresponding to the suction openings, similar refrigerant passages can be easily realized by mounting the attachment to the partition wall, allowing easy retrofitting to an existing electric compressor.

Furthermore, the casing has at its bottom an enlarged portion swollen outwardly, and the inlet of the refrigerant passages is situated in the enlarged portion, whereby it is possible to efficiently guide lubricant threatening to gather to the refrigerant passages.

What is claimed is:

1. A horizontal-type electric motor driven compressor comprising:

a casing;

a suction chamber formed in the casing;

a motor arranged on a suction chamber side in the casing;

a compressor section driven by the motor in the casing about a horizontal axis of rotation extending in a longitudinal direction of the casing;

a suction opening provided in the compressor section; and a refrigerant passage having an inlet communicating with the suction opening and communicating the suction chamber to the suction opening, the refrigerant passage being the sole refrigerant passage between the suction chamber and the suction opening, and the inlet of the refrigerant passage being provided in a lowermost portion at a bottom of the casing.

2. A horizontal-type electric motor driven compressor according to claim 1; wherein the compressor section comprises a rotary member having a rotor shaft and a stationary member supporting the rotary member and having the suction opening; and wherein the refrigerant passage has an introduction passage formed in the stationary member and extending from the suction opening to the inlet in a lower portion of the stationary member.

3. A horizontal-type electric motor driven compressor according to claim 2; wherein the casing has a partition wall disposed in contact with the stationary member, the introduction passage comprising a groove formed in the stationary member and covered with the partition wall; and wherein the inlet of the refrigerant passage comprises an opening hole communicating with the groove and provided in a lower portion of the partition wall.

4. A horizontal-type electric motor driven compressor according to claim 2; wherein the introduction passage is formed by a groove formed in the stationary member and covered with a cover member mounted to the stationary member so as to allow a lower end of the groove to communicate with the suction chamber; and wherein the lower end of the groove forms the inlet of the refrigerant passage.

5. A horizontal-type electric motor driven compressor according to claim 1; wherein the compressor section comprises a rotary member having a rotor shaft and a stationary member supporting the rotary member and having the suction opening; and wherein the refrigerant passage comprises a communication hollow portion formed in an attachment mounted to the stationary member and corresponding to the suction opening, and an introduction passage extending from the communication hollow portion to a lower end portion of the attachment, a lower end of the introduction passage forming the inlet of the refrigerant passage.

6. A horizontal-type electric motor driven compressor according to claim 1; wherein the casing has a partition wall on the suction chamber side and has in the partition wall a suction hole corresponding to the suction opening; and wherein the refrigerant passage comprises a communication hollow portion formed in an attachment mounted to the partition wall and an introduction passage extending from the communication hollow portion to a lower end portion of the attachment, a lower end of the introduction passage forming the inlet of the refrigerant passage.

7. A horizontal-type electric motor driven compressor according to claim 1; wherein the casing has an enlarged portion with a bottom part projecting outwardly in a circumferential direction of the casing, the inlet of the refrigerant passage being disposed at the enlarged portion.

8. An electric compressor comprising:

a casing having an upper part and a lower part;

a suction chamber formed in the casing;

a rotary member disposed in the casing and having a rotor shaft;

a stationary member supporting the rotary member and having a suction opening; and a refrigerant passage having an inlet disposed in the lower part of the casing and communicating the suction chamber to the suction opening of the stationary member, the refrigerant passage comprising a hollow portion formed in an attachment mounted to the stationary member and corresponding to the suction opening, and an introduction passage extending from the hollow portion to the lower part of the casing, a lower end of the introduction passage forming the inlet.

9. An electric compressor according to claim 8; further comprising a motor arranged on a suction chamber side in the casing for rotating the rotary member.

10. An electric compressor according to claim 8; wherein the refrigerant passage is the sole refrigerant passage between the suction chamber and the suction opening.

11. An electric compressor according to claim 8; wherein the electric compressor comprises a horizontal-type electric motor driven compressor.

12. An electric compressor according to claim 11; further comprising an electric motor arranged on a suction chamber side in the casing for rotating the rotary member.

13. An electric compressor according to claim 8; wherein the lower part of the casing has an enlarged portion projecting outwardly in a circumferential direction of the casing; and wherein the inlet of the refrigerant passage is disposed at the enlarged portion.

14. An electric compressor comprising:

a casing having an upper part and a lower part;

a suction chamber formed in the casing;

a rotary member disposed in the casing and having a rotor shaft;

a stationary member supporting the rotary member and having a suction opening;

a partition wall forming part of the casing and disposed in contact with the stationary member; and a refrigerant passage having an inlet disposed in the lower part of the casing and communicating the suction chamber to the suction opening of the stationary member, and having an introduction passage comprising a groove covered by the partition wall and formed in the stationary member and extending from the suction opening to the inlet, the inlet comprising an opening hole communicating with the groove and disposed in a lower portion of the partition wall.

15. An electric compressor according to claim 14; further comprising a motor arranged on a suction chamber side in the casing for rotating the rotary member.

16. An electric compressor according to claim 14; wherein the refrigerant passage is the sole refrigerant passage between the suction chamber and the suction opening.

17. An electric compressor according to claim 14; wherein the electric compressor comprises a horizontal-type electric motor driven compressor.

18. An electric compressor according to claim 17; further comprising an electric motor arranged on a suction chamber side in the casing for rotating the rotary member.

19. An electric compressor according to claim 14; wherein the lower part of the casing has an enlarged portion projecting outwardly in a circumferential direction of the casing; and wherein the inlet of the refrigerant passage is disposed at the enlarged portion.

20. An electric compressor according to claim 14; wherein a lower end of the groove forms the opening hole.

* * * * *